US008257509B2

(12) United States Patent
Herzog et al.

(10) Patent No.: US 8,257,509 B2
(45) Date of Patent: Sep. 4, 2012

(54) METHOD AND APPARATUS FOR DERIMING CRYOGENIC EQUIPMENT

(75) Inventors: Karl L. Herzog, Houston, TX (US); Jon M. Mock, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 24 days.

(21) Appl. No.: 13/028,852

(22) Filed: Feb. 16, 2011

(65) Prior Publication Data

US 2011/0197925 A1 Aug. 18, 2011

Related U.S. Application Data

(63) Continuation-in-part of application No. 12/694,627, filed on Jan. 27, 2010.

(51) Int. Cl.
*B08B 9/00* (2006.01)
*B08B 9/093* (2006.01)
*F28G 1/12* (2006.01)

(52) U.S. Cl. ..... 134/22.12; 134/22.1; 134/22.14; 134/22.18; 134/22.19; 134/184; 165/95

(58) Field of Classification Search ..... 134/22.1, 134/22.12, 22.18, 22.19, 184; 165/95
See application file for complete search history.

(56) References Cited

U.S. PATENT DOCUMENTS

| | | | | | |
|---|---|---|---|---|---|
| 2,499,404 | A | * | 3/1950 | Marsh | 62/54.2 |
| 2,712,730 | A | * | 7/1955 | Spangler | 62/611 |
| 3,152,016 | A | | 10/1964 | Drushella | |
| 3,241,614 | A | * | 3/1966 | Bertness | 166/304 |
| 3,274,789 | A | | 9/1966 | Mitchell | |
| 3,407,052 | A | * | 10/1968 | Huntress et al. | 48/127.3 |
| 3,420,068 | A | * | 1/1969 | Petit | 62/623 |
| 3,718,586 | A | * | 2/1973 | Rollo et al. | 507/259 |
| RE29,424 | E | * | 10/1977 | Bognaes et al. | 62/53.2 |
| RE29,463 | E | * | 11/1977 | Bognaes et al. | 62/53.2 |
| 4,813,986 | A | | 3/1989 | Humble et al. | |
| 4,925,497 | A | | 5/1990 | Thierheimer, Jr. | |
| 5,018,544 | A | * | 5/1991 | Boisture et al. | 134/111 |
| 5,941,691 | A | | 8/1999 | Stephens | |
| 6,470,690 | B1 | * | 10/2002 | Sicherman | 62/48.1 |
| 6,923,007 | B1 | * | 8/2005 | Markham et al. | 62/50.6 |
| 7,043,938 | B2 | | 5/2006 | Narayan et al. | |
| 2007/0175796 | A1 | * | 8/2007 | Mock | 208/208 R |
| 2008/0115529 | A1 | * | 5/2008 | Ransbarger et al. | 62/613 |
| 2008/0115530 | A1 | * | 5/2008 | Mock et al. | 62/620 |
| 2009/0126401 | A1 | * | 5/2009 | Mock et al. | 62/611 |
| 2011/0011127 | A1 | * | 1/2011 | Evans et al. | 62/613 |

* cited by examiner

*Primary Examiner* — Michael Kornakov
*Assistant Examiner* — Katelyn Whatley
(74) *Attorney, Agent, or Firm* — ConocoPhillips Company

(57) ABSTRACT

The present invention relates to a method and an apparatus for liquefying natural gas.

29 Claims, 1 Drawing Sheet

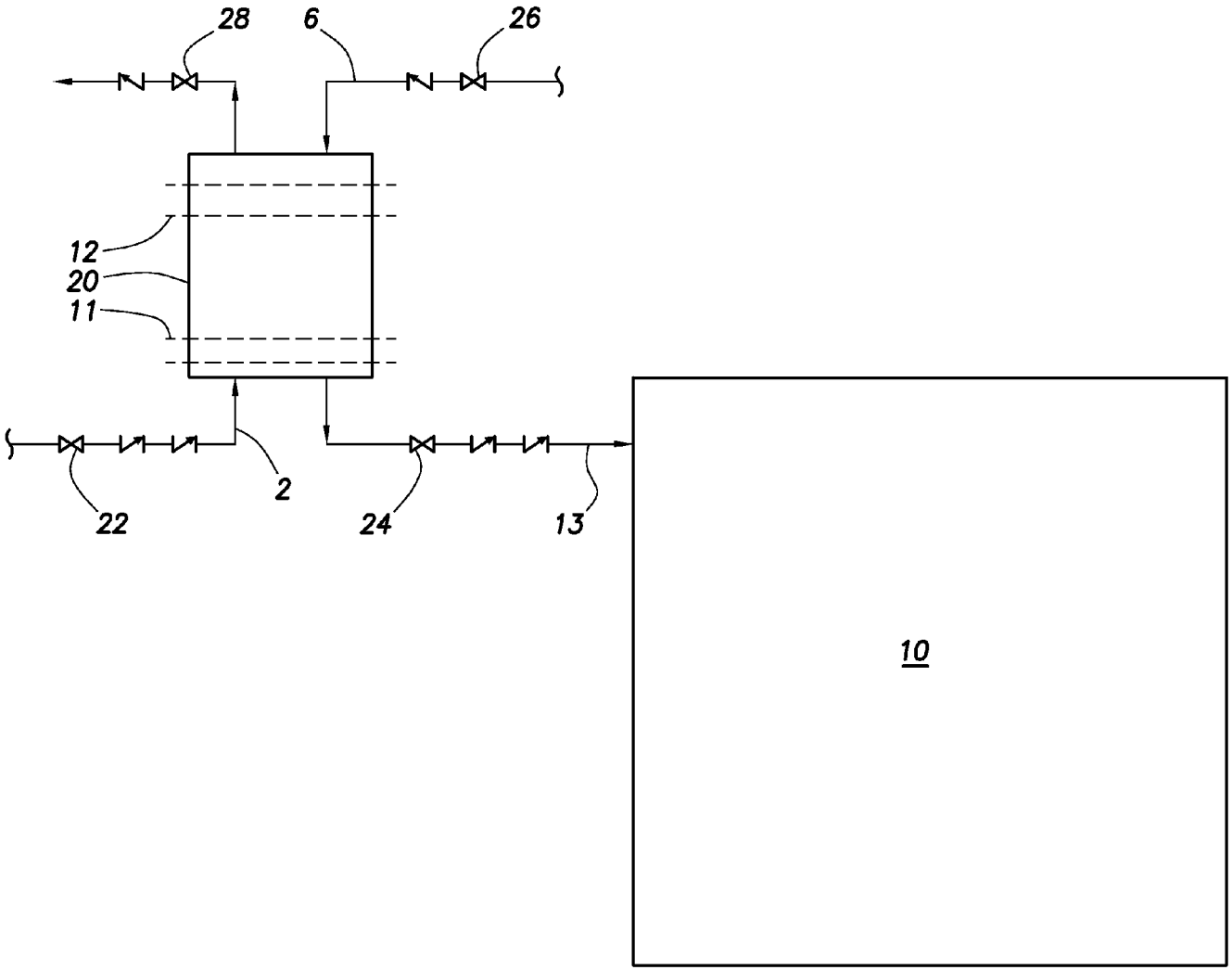
26
28
6
12
20
11
2
22
24
13
10

METHOD AND APPARATUS FOR DERIMING CRYOGENIC EQUIPMENT

CROSS-REFERENCE TO RELATED APPLICATIONS

This application is a Continuation-in-Part of U.S. patent application Ser. No. 12/694,627 filed on Jan. 27, 2010 entitled "Method and System for Deriming Cryogenic Heat Exchangers," which is incorporated herein by reference in its entirety.

FIELD OF THE INVENTION

The present invention relates to a method and an apparatus for liquefying natural gas. More particularly, but not by way of limitation, embodiments of the present invention relates to a method and an apparatus for enhancing the production of liquefied natural gas. More particularly, but not by way of limitation, embodiments of the present invention concern a method and an apparatus for deriming the interior surfaces of cryogenic equipment.

BACKGROUND OF THE INVENTION

The cryogenic liquefaction of natural gas is routinely practiced as a means of converting natural gas into a more convenient form for transportation and storage. Such liquefaction reduces the volume of the natural gas by about 600-fold and results in a product which can be stored and transported at or near atmospheric pressure.

Natural gas is frequently transported by pipeline from the supply source to a distant market. While it is desirable to operate the pipeline under a substantially constant and high load factor, often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when demand exceeds supply. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessel. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems).

In any natural gas liquefaction process, there will be progressive accumulation of buildup upon the interior surfaces of the cryogenic heat exchanger. Such buildup can be caused by water in the form of ice or relatively heavy hydrocarbons present in the gas feed in solid form. The various sections of the cryogenic heat exchanger operate at different temperatures depending upon what stream is passing through a particular section. For example, one section of the cryogenic heat exchanger can operate at an inlet temperature of −35° F. and an outlet temperature of −50° F., while a nearby or contiguous section can operate at an inlet temperature of −147° F. and an outlet temperature of a temperature colder than −147° F. while yet another nearby or contiguous section in the cryogenic heat exchanger can operate at an inlet temperature of −147° F. and an outlet temperature of −204° F. Thus, it can be seen that a specific stream containing materials having various freeze points may pass through one or more sections of the unit without forming a buildup, but the same stream may encounter a separate section operating at a lower temperature than the other section(s), and buildup can ultimately result thus adversely affecting the overall heat transfer efficiency of the unit. Build-up of solids in these cryogenic heat exchangers, control valves and other associated equipment can lead to reduced heat transfer, high pressure drop and/or reduced flow resulting in a decrease in LNG production.

Of special concern, is the need for the removal, or deriming (or "defrosting"), of heavy hydrocarbons which precipitate, wax or freeze in small passageways of cryogenic equipment. Build-up of solids in these systems can lead to reduced heat transfer, high pressure drop and/or reduced flow resulting in a decrease of LNG production. Liquid petroleum gas (LPG) as a deriming solvent, as well as other liquid solvents, have been utilized in efforts to remove such buildup while the equipment remains in operation. However, for many applications in high pressure portions of the plant, motor-driven metering pumps for injection of liquid solvents into the process can be difficult to acquire and may have limitations on the flow rate and/or the pressure head required for the service.

Therefore, a need exists for improved equipment and methods to facilitate the removal, or de-riming, of heavy hydrocarbons that precipitate, wax up or freeze in the passages of cryogenic equipment, such as cryogenic heat exchangers, control valves and other associated equipment.

SUMMARY OF THE INVENTION

In an embodiment, a method of removing buildup in cryogenic equipment, the method includes: (a) closing a first exit valve, a second inlet valve, and a second exit valve of a pumping vessel; (b) opening a first inlet valve of the pumping vessel, wherein the first inlet valve controls the supply of a solvent into the pumping vessel; (c) closing the first inlet valve of the pumping vessel upon reaching a predetermined maximum solvent level within the pumping vessel; (d) opening the second inlet valve of the pumping vessel to re-pressurize the pumping vessel with a process gas; (e) opening the first exit valve of the pumping vessel upon re-pressurization of the pumping vessel; (f) continuously operating the second inlet valve to maintain a predetermined pressure level within the pumping vessel; (g) delivering the solvent from the pumping vessel into the cryogenic equipment via the first exit valve; (h) closing the first exit valve of the pumping vessel upon reaching a predetermined minimum solvent level in the pumping vessel; (i) closing the second inlet valve of the pumping vessel; (j) opening the second exit valve of the pumping vessel, wherein opening the second exit valve of the pumping vessel decreases the pressure within the pumping vessel; (k) continuously measuring the pressure level and the solvent level within the pumping vessel, wherein measuring indicators continuously monitor the pressure level and the solvent level by continuously delivering readings of the pressure level and the solvent levels to an automated control system; and (l) repeating steps (a)-(j) until the buildup in the cryogenic equipment is removed.

In another embodiment, a method of removing buildup in cryogenic equipment, the method includes: (a) closing a first exit valve, a second inlet valve, and a second exit valve of a pumping vessel; (b) opening a first inlet valve of the pumping vessel, wherein the first inlet valve is any valve capable of either manual or automated operation, wherein the first inlet valve controls the supply of a solvent into the pumping vessel, wherein the solvent is any solvent capable of removing buildup in cryogenic equipment; (c) closing the first inlet valve of the pumping vessel upon reaching a predetermined maximum solvent level within the pumping vessel; (d) opening the second inlet valve of the pumping vessel to re-pressurize the pumping vessel with a process gas, wherein the second inlet valve is a gas pressure regulating control valve suitable for manual or automated operation based on the measure pressure in the pumping vessel, wherein the process gas is capable of existing with or become soluble within the solvent without negatively impacting the integrity of the solvent; (e) opening the first exit valve of the pumping vessel upon re-pressurization of the pumping vessel, wherein the first exit valve is any valve suitable for manual or automated operation; (f) continuously operating the second inlet valve to maintain a predetermined pressure level within the pumping vessel; (g) delivering the solvent from the pumping vessel into the cryogenic equipment via the first exit valve, wherein the solvent is delivered to the cryogenic equipment at an operationally practical flow rate; (h) closing the first exit valve of the pumping vessel upon reaching a predetermined minimum solvent level in the pumping vessel; (i) closing the second inlet valve of the pumping vessel; (j) opening the second exit valve of the pumping vessel, wherein the second exit valve is any valve suitable for manual or automated operation, wherein opening the second exit valve of the pumping vessel decreases the pressure within the pumping vessel; (k) continuously measuring the pressure level and the solvent level within the pumping vessel, wherein measuring indicators continuously monitor the pressure level and the solvent level by continuously delivering readings of the pressure level and the solvent levels to an automated control system; and (l) repeating steps (a)-(j) until the buildup in the cryogenic equipment is removed.

In yet another embodiment, an apparatus for removing buildup in cryogenic equipment, the apparatus includes: (a) a pumping vessel, wherein the pumping vessel includes a first inlet valve, wherein the first inlet valve controls the supply of a solvent into the pumping vessel, a second inlet valve, wherein the second inlet valve controls the supply and pressure of a process gas into the pumping vessel, a first exit valve, wherein the first exit valve controls the delivery of solvent into the cryogenic equipment, wherein the solvent is suitably gas-pressurized upon exiting the first exit valve, and a second exit valve, wherein the second exit valve controls the exhaust of the process gas; and (b) a delivery means for delivering the solvent from the first exit valve of the pumping vessel into the cryogenic equipment under the pressure of the process gas.

BRIEF DESCRIPTION OF THE DRAWINGS

The present invention is shown by way of example and not by limitation in the accompanying figures, in which:

FIG. 1 is a schematic diagram of one embodiment of the deriming process according to the present invention.

DETAILED DESCRIPTION OF THE INVENTION

Reference will now be made in detail to embodiments of the invention. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used in another embodiment to yield a still further embodiment. Thus, it is intended that the present invention cover such modifications and variations that come within the scope of the appended claims and their equivalents.

A cascaded LNG process uses one or more refrigerant systems for sequentially transferring heat energy from the natural gas stream to the environment where different refrigeration systems may use different refrigerants. Each refrigeration system functions as a heat pump by removing heat energy from the natural gas stream as the stream is progressively cooled to lower and lower temperatures. In so doing, the thermal energy removed from the natural gas stream is ultimately rejected (pumped) to the environment via energy exchange with one or more refrigerants.

The design of a cascaded refrigeration process involves the balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment and the proper selection of flow rates through such equipment so as to ensure that both flow rates and approach and outlet temperatures are compatible with the required heating/cooling duty.

One of the most efficient and effective means of liquefying natural gas is via a cascade-type operation in combination with expansion-type cooling. Such a liquefaction process is comprised of the sequential cooling of a natural gas stream at an elevated pressure, for example about 625 psia, by passage through a multistage propane cycle, a multistage ethane or ethylene cycle, and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point. As used herein, the term "propane chiller" shall denote a cooling system that employs a refrigerant having a boiling point the same as, or similar to, that of propane or propylene. As used herein, the term "ethylene chiller" shall denote a cooling system that employs a refrigerant having a boiling point the same as, or similar to, that of ethane or ethylene. As used herein, the terms "upstream" and "downstream" shall be used to describe the relative positions of various components of a natural gas liquefaction plant along the flow path of natural gas through the plant.

Various pretreatment steps provide a means for removing undesirable components, such as acid gases, mercaptan, mercury, and moisture from the natural gas feed stream delivered to the facility. The composition of this gas stream may vary significantly. As used herein, a natural gas stream is any stream principally comprised of methane which originates in major portion from a natural gas feed stream, such feed stream for example containing at least 85 percent methane by volume, with the balance being ethane, higher hydrocarbons, nitrogen, carbon dioxide and a minor amounts of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily available to one skilled in the art: (1) acid gases and to a lesser extent mercaptan are routinely removed via a sorption process employing an aqueous amine-bearing solution; (2) a major portion of the water is routinely removed as a liquid via two-phase gas-liquid separation following gas compression and cooling upstream of the initial cooling cycle and also downstream of the first cooling stage in the initial cooling cycle; (3) mercury is routinely removed via mercury sorbent beds and (4) residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure, that being a pressure greater than 500 psia, preferably about 500 psia to about 900 psia, still more preferably about 500 psia to about 675 psia, still yet more preferably about 600 psia to about 675 psia, and most preferably about 625 psia. The stream temperature is typically near ambient to slightly above ambient. A representative temperature range being 60° F. to 138° F.

As previously noted, the natural gas feed stream is cooled in a plurality of multistage (for example, three) cycles or steps by an indirect heat exchange with a plurality of refrigerants, preferably three. As used herein, the term "heat exchanger" broadly means any device capable of transferring heat from one media to another media, including particularly any structure, e.g., device commonly referred to as a heat exchanger. Thus, the heat exchanger may be a plate-fin, shell-and-tube, spiral core-in-kettle or any other type of heat exchanger. Preferably, the heat exchanger is a brazed aluminum plate-fin type. The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in the first closed refrigeration cycle utilizing a relatively high boiling refrigerant. Such refrigerant is preferably comprised in major portion of propane, propylene or mixtures thereof, more preferably the refrigerant comprises at least about 75 mole percent propane, even more preferably at least 90 mole percent propane, and most preferably the refrigerant consists essentially of propane.

Thereafter, the processed feed gas flows through an effective number of stages, nominally two, preferably two to four, and more preferably two or three, in a second closed refrigeration cycle in heat exchange with a refrigerant having a lower boiling point. Such refrigerant is preferably comprised in major portion of ethane, ethylene or mixtures thereof, more preferably the refrigerant comprises at least about 75 mole percent ethylene, even more preferably at least 90 mole percent ethylene, and most preferably the refrigerant consists essentially of ethylene. Each cooling stage comprises a separate cooling zone. As previously noted, the processed natural gas feed stream is combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion, preferably in its entirety thereby producing a pressurized LNG-bearing stream. Generally, the process pressure at this location is only slightly lower than the pressure of the pretreated feed gas to the first stage of the first cycle.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much as possible of the $C_2$ and higher molecular weight hydrocarbons from the gas to produce a gas stream predominating in methane and a liquid stream containing significant amounts of ethane and heavier components. An effective number of gas/liquid separation means are located at strategic locations downstream of the cooling zones for the removal of liquid streams rich in $C_2$+ components. The exact location and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications and other factors routinely considered by those skilled in the art of the LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, the methane-rich stream can be repressurized and recycled or can be used as fuel gas. The $C_2$+ hydrocarbon stream or streams or the demethanized $C_2$+ hydrocarbon stream may be used as fuel or may be further processed such as by fractionation in one or more fractionation zones to produce individual streams rich in specific chemical constituents (e.g., $C_2$, $C_3$, $C_4$ and $C_5$+).

The pressurized LNG-bearing stream is further cooled in a third cycle or step referred to as the open methane cycle via contact in a main methane economizer with flash gases (i.e., flash gas streams) generated in this third cycle in a manner to be described later and via expansion of the pressurized LNG-bearing stream to near atmospheric pressure. The flash gasses used as a refrigerant in the third refrigeration cycle are preferably comprised in major portion of methane, more preferably the refrigerant comprises at least about 75 mole percent methane, still more preferably at least 90 mole percent methane, and most preferably the refrigerant consists essentially of methane. During expansion of the pressurized LNG-bearing stream to near atmospheric pressure, the pressurized LNG-bearing stream is cooled via at least one, preferably two to four, and more preferably three expansions where each expansion employs as a pressure reduction means either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash step will frequently more than off-set the more expensive capital and operating costs associated with the expander. In one embodiment, additional cooling of the pressurized LNG-bearing stream prior to flashing is made possible by first flashing a portion of this stream via one or more hydraulic expanders and then via indirect heat exchange means employing said flash gas stream to cool the remaining portion of the pressurized LNG-bearing stream prior to flashing. The warmed flash gas stream is then recycled via return to an appropriate location, based on temperature and pressure considerations, in the open methane cycle and will be recompressed.

When the pressurized LNG-bearing stream, preferably a liquid stream, entering the third cycle is at a preferred pressure of about 550-650 psia, representative flash pressures for a three stage flash process are about 170-210, 45-75, and 10-40 psia. Flashing of the pressurized LNG-bearing stream, preferably a liquid stream, to near atmospheric pressure produces an LNG product possessing a temperature of about −240° F. to −260° F.

The liquefaction process may use one of several types of cooling which include but is not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion.

Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

As previously discussed a method, a system and an apparatus are presented to facilitate the injection of solvent(s) against high pressure into an operating LNG process for the purpose of effecting the removal, or deriming, of progressive accumulation of buildup, such as water in the form of ice and relatively heavy hydrocarbons present in the gas feed in solid form, upon the interior surfaces of the cryogenic heat exchanger. The flow rate of the solvent(s) injection can be adjusted and controlled to an operationally practical level to suit the needs of the operators of the LNG process.

Referring to FIG. 1, a pumping vessel 20 provides a mechanism for the injection of solvent into cryogenic equipment 10 using process gas as the motive force. The pumping vessel 20 includes a pump chamber 21 defined by a pump housing; a first inlet valve 22 for controlling the supply of solvent into the pumping vessel; a first exit valve 24 for discharging or injecting solvent from the pumping vessel 20 into the cryogenic equipment 10; a second inlet valve 26 for controlling the supply of process gas into the pumping vessel 20; and a second exit valve 28 for exhaust of process gas from the pumping vessel 20.

The cyclical process begins when the first inlet valve 22 of the pumping vessel 20 is opened to allow solvent to flow from an external solvent storage system (not shown) via conduit 2 into the pumping vessel 20 through the first inlet valve 22. The first exit valve 24, the second inlet valve 26 and, typically, but not necessarily, the second exit valve 28 are each in closed positions during this step of the cyclical operation. Upon reaching a predesigned maximum solvent level 12, the first inlet valve 22 is closed, thus preventing any additional solvent from entering the pumping vessel 20. A level indicator (not shown) may be used for continuous measurement of the liquid level in pumping vessel 20.

The second inlet valve 26 of the pumping vessel 20 is then opened to allow process gas to flow via conduit 6 into the vessel through the second inlet valve 26. (The second exit valve 28 should first be closed, if it was designed to be opened during the preceding step.) The source of the process gas can be from an upstream process location operating at higher pressure than that of the LNG process pressure within cryogenic equipment 10. The process gas re-pressurizes the pumping vessel 20 to a predetermined pressure level above that of the LNG process pressure within the cryogenic equipment 10. When the pumping vessel 20 is thereby re-pressurized with motive gas, the first exit valve 24 is opened to allow discharge of the solvent through the first exit valve 24 and into the cryogenic equipment 10 via conduit 13. A pressure indicator (not shown) will be used for continuous measurement of the pressure level within the pumping vessel 20. The second inlet valve 26 will then be continuously operated, i.e., opened or closed, as necessary to maintain the predetermined pressure level in the pumping vessel 20 as the liquid level decreases. The higher the predetermined pressure level, the greater the rate of introduction of solvent into the cryogenic equipment 10. The solvent is delivered to the cryogenic equipment 10 at a nearly constant flow rate during this step of the cyclical operation. The flow rate is adjustable by selection of the predetermined pressure level in combination with the design flow characteristics of the first exit valve 24 and of other components (for example, non-return valves) which may be included in the design of conduit 13. Furthermore, the first exit valve 24 may, optionally, be adjusted, based on the continuous level measurement, during the injection process to provide for greater constancy of the rate of level decrease and hence, rate of injection.

Upon reaching a predesigned minimum solvent level 11 within the pump chamber 21 of the pumping vessel 20, the first exit valve 24 is closed, thus preventing any further flow of solvent through the first exit valve 24 into the cryogenic equipment 10. The second inlet valve 26 of the pumping vessel 20 is then closed. The second exit valve 28, which controls the exhaust of the process gas, is then opened to decrease the pressure within the pumping vessel 20, thus placing the vessel into a lower pressure level and thereby being capable of being re-filled with solvent from external storage. The exhausted process gas may be recycled to a low pressure destination within the process or it may be directed to a flare system. The cyclical process is repeated until the buildup in the cryogenic equipment 10 is removed.

The pumping action can provide for an operationally practical constant for the overall flow rate of the delivery of solvent(s) to the cryogenic equipment 10 with interruptions, as described above. For example, when: the pumping vessel 20 is re-filled with solvent; the pumping vessel 20 is re-pressurized with process gas; process gas is exhausted from the pumping vessel as necessary to allow for re-filling with solvent. The degree to which the overall flow rate of solvent can be impacted by these interruptions can be minimized, as are deemed practical, through certain design choices. For example, by: enlarging the volumetric capacity of pumping vessel 20, specifically by increasing the volumetric capacity between minimum solvent level 11 and maximum solvent level 12; increasing the available pressure head in or from the external solvent storage system (not shown) thereby reducing the time of re-filling the pumping vessel 20 with solvent; or selecting of a lower pressure destination for exhaust gas thereby reducing the pressure in the pumping vessel 20 at the beginning of the solvent re-filling step resulting in less time for re-filling.

The pressure level and solvent level, within the pumping vessel 20 are continuously measured. The measuring indicators can continuously deliver pressure and solvent level readings to an automated control system, such as a Distributed Control System (DCS) or a Programmable Logic Control (PLC) system. The automated control system can automatically adjust the positioning of the valves to either opened or closed, to either fully or differentially, as required to automatically perform the operational method and sequence described above.

In an embodiment, the pumping vessel 20 is a positive displacement pump. In another embodiment, the pump is a quasi-positive displacement pump. In another embodiment, the pumping vessel 20 is a blowcase. In a further embodiment, the pumping vessel 20 is a mechanical pressure power pump.

In an embodiment, the solvent is any solvent capable of removing buildup in cryogenic equipment. In another embodiment, the solvent is a deriming solvent. In yet another embodiment, the solvent is liquid hydrocarbon. In a further embodiment, the solvent is liquid petroleum gas (LPG). In yet a further embodiment, other liquid hydrocarbons which can be expected to be suitably remove buildup within cryogenic equipment can also be utilized. For example, liquefied gas mixtures containing varying fractions of about 0.1 to 80 volume percent or higher methane, ethane, propane, butane, and hexane of distillation.

The process gas utilized in the pumping vessel 20 is capable of existing with, or becoming soluble within, the solvent without negatively impacting the integrity of the solvent or of the quality of the LNG flowing through the effected process equipment. In an embodiment, the process gas is a motive gas. In yet another embodiment, the process gas is a high pressure motive gas.

As previously discussed, the injection of the solvent into the cryogenic equipment assists in the alleviation and elimination of progressive accumulation of buildup within the cryogenic equipment, while allowing the solvent to be delivered to the cryogenic equipment at an adjustable but controlled rate during its periods of operation. In an embodiment, the apparatus is operated continuously for a predetermined length of time then discontinued. In another embodiment, the apparatus is operated intermittently over a predetermined length of time, but with predetermined pauses and then resumptions of the operational cycle. In all embodiments, the total volume of solvent(s) injected is known by virtue of the level indication and/or the number of cycles performed.

In an embodiment, the first inlet valve 22 is any valve suitable for manual or automated actuation with typically, but not necessarily, full open-full shut action. In another embodiment, the first inlet valve 22 is a globe valve or other flow control valve operated either manually or automatically to provide for a more finely controlled rate of solvent re-filling based on measurements of level in the pumping vessel 20.

In an embodiment, the first exit valve 24 is any valve suitable for manual or automated actuation with typically, but not necessarily, reproducible flow-versus-differential head characteristics when caused to become open. In yet another embodiment, the first exit valve 24 is a globe valve or other flow control valve modulated either manually or automatically to provide for improved control of the rate of solvent injection to the effected cryogenic equipment 10 based on measurements of level in the pumping vessel 20 irrespective of the fluctuations in the pressure of the motive gas.

In an embodiment, the second inlet valve 26 is a gas pressure regulating control valve suitable for manual or automated operation based on the measured pressure in the pumping vessel. In another embodiment, the second inlet valve 26 may be capable of being reset to provide no gas flow, irrespective of the normal operating pressure setpoint, except during periods of solvent injection into the effected cryogenic equipment. In another embodiment, the second inlet valve 26 is a two-valve assembly including of a gas pressure regulating control valve supplied with process gas by way of an upstream valve capable of being fully shut, except during periods of solvent injection.

In an embodiment, the second exit valve 28 is any valve suitable for manual or automated actuation with typically, but not necessarily, full open-full shut action.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described in the present invention. It is the intent of the inventors that variations and equivalents of the invention are within the scope of the claims below and the description, abstract and drawings not to be used to limit the scope of the invention

The invention claimed is:

1. A method of removing buildup in cryogenic equipment, the method comprising:

a. closing a first exit valve, a second inlet valve, and a second exit valve of a pumping vessel;

b. opening a first inlet valve of the pumping vessel, wherein the first inlet valve controls the supply of a solvent into the pumping vessel;

c. closing the first inlet valve of the pumping vessel upon reaching a predetermined maximum solvent level within the pumping vessel;

d. opening the second inlet valve of the pumping vessel to re-pressurize the pumping vessel with a process gas;

e. opening the first exit valve of the pumping vessel upon re-pressurization of the pumping vessel;

f. continuously operating the second inlet valve to maintain a predetermined pressure level within the pumping vessel;

g. delivering the solvent from the pumping vessel into the cryogenic equipment via the first exit valve;

h. closing the first exit valve of the pumping vessel upon reaching a predetermined minimum solvent level in the pumping vessel;

i. closing the second inlet valve of the pumping vessel;

j. opening the second exit valve of the pumping vessel, wherein opening the second exit valve of the pumping vessel decreases the pressure within the pumping vessel;

k. continuously measuring the pressure level and the solvent level within the pumping vessel, wherein measuring indicators continuously monitor the pressure level and the solvent level by continuously delivering readings of the pressure level and the solvent levels to an automated control system; and l. repeating steps (a)-(j) until the buildup in the cryogenic equipment is removed.

2. The method according to claim 1, wherein the pumping vessel is a positive displacement pump.

3. The method according to claim 2, wherein the pumping vessel is a quasi-positive displacement pump.

4. The method according to claim 1, wherein the pumping vessel is a blowcase.

5. The method according to claim 1, wherein the pumping vessel is a mechanical pressure power pump.

6. The method according to claiml, wherein the solvent is any solvent capable of removing buildup in cryogenic equipment.

7. The method according to claim 6, wherein the solvent is liquid hydrocarbon.

8. The method according to claim 6, wherein the solvent is about 0.1 to about 80 volume percent methane, ethane, propane, butane, and hexane of distillation.

9. The method according to claim 6, wherein the solvent is liquid petroleum gas.

10. The method according to claim 1, wherein the process gas is capable of existing with or become soluble within the solvent without negatively impacting the integrity of the solvent.

11. The method according to claim 10, wherein the process gas is a motive gas.

12. The method according to claim 11, wherein the process gas is a high pressure motive gas.

13. The method according to claim 1, wherein the solvent is delivered to the cryogenic equipment at a controlled flow rate.

14. The method according to claim 1, wherein the solvent is delivered to the cryogenic equipment at an operationally practical flow rate.

15. The method according to claim 1, wherein the first inlet valve is any valve capable of either manual or automated operation.

16. The method according to claim 1, wherein the first exit valve is any valve suitable for manual or automated operation.

17. The method according to claim 1, wherein the second inlet valve is a gas pressure regulating control valve suitable for manual or automated operation based on the measure pressure in the pumping vessel.

18. The method according to claim 1, wherein the second exit valve is any valve suitable for manual or automated operation.

19. A method of removing buildup in cryogenic equipment, the method comprising:

a. closing a first exit valve, a second inlet valve, and a second exit valve of a pumping vessel;

b. opening a first inlet valve of the pumping vessel, wherein the first inlet valve is any valve capable of either manual or automated operation, wherein the first inlet valve controls the supply of a solvent into the pumping vessel, wherein the solvent is any solvent capable of removing buildup in cryogenic equipment;

c. closing the first inlet valve of the pumping vessel upon reaching a predetermined maximum solvent level within the pumping vessel;

d. opening the second inlet valve of the pumping vessel to re-pressurize the pumping vessel with a process gas, wherein the second inlet valve is a gas pressure regulating control valve suitable for manual or automated operation based on the measure pressure in the pumping vessel, wherein the process gas is capable of existing with or become soluble within the solvent without negatively impacting the integrity of the solvent;

e. opening the first exit valve of the pumping vessel upon re-pressurization of the pumping vessel, wherein the first exit valve is any valve suitable for manual or automated operation;

f. continuously operating the second inlet valve to maintain a predetermined pressure level within the pumping vessel;

g. delivering the solvent from the pumping vessel into the cryogenic equipment via the first exit valve, wherein the solvent is delivered to the cryogenic equipment at an operationally practical flow rate;

h. closing the first exit valve of the pumping vessel upon reaching a predetermined minimum solvent level in the pumping vessel;

i. closing the second inlet valve of the pumping vessel;

j. opening the second exit valve of the pumping vessel, wherein the second exit valve is any valve suitable for manual or automated operation, wherein opening the second exit valve of the pumping vessel decreases the pressure within the pumping vessel;

k. continuously measuring the pressure level and the solvent level within the pumping vessel, wherein measuring indicators continuously monitor the pressure level and the solvent level by continuously delivering readings of the pressure level and the solvent levels to an automated control system; and l. repeating steps (a)-(j) until the buildup in the cryogenic equipment is removed.

20. The method according to claim 19, wherein the pumping vessel is a positive displacement pump.

21. The method according to claim 20, wherein the pumping vessel is a quasi-positive displacement pump.

22. The method according to claim 19, wherein the pumping vessel is a blowcase.

23. The method according to claim 19, wherein the pumping vessel is a mechanical pressure power pump.

24. The method according to claim 19, wherein the solvent is liquid hydrocarbon.

25. The method according to claim 19, wherein the solvent is about 0.1 to about 80 volume percent methane, ethane, propane, butane, and hexane of distillation.

26. The method according to claim 19, wherein the solvent is liquid petroleum gas.

27. The method according to claim 19, wherein the process gas is a motive gas.

28. The method according to claim 27, wherein the process gas is a high pressure motive gas.

29. The method according to claim 19, wherein the solvent is delivered to the cryogenic equipment at a controlled flow rate.

* * * * *